US008565460B2

(12) United States Patent
Takagi et al.

(10) Patent No.: US 8,565,460 B2
(45) Date of Patent: Oct. 22, 2013

(54) HEARING AID DEVICE

(75) Inventors: Yoshiaki Takagi, Kanagawa (JP); Gempo Ito, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/515,080

(22) PCT Filed: Oct. 17, 2011

(86) PCT No.: PCT/JP2011/005784
§ 371 (c)(1),
(2), (4) Date: Jun. 11, 2012

(87) PCT Pub. No.: WO2012/056645
PCT Pub. Date: May 3, 2012

(65) Prior Publication Data

US 2012/0250915 A1 Oct. 4, 2012

(30) Foreign Application Priority Data

Oct. 26, 2010 (JP) ..... 2010-239247
Jun. 13, 2011 (JP) ..... 2011-130877

(51) Int. Cl.
*H04R 25/00* (2006.01)

(52) U.S. Cl.
USPC ..... 381/321; 381/23.1; 381/312

(58) Field of Classification Search
USPC ..... 381/23.1, 312, 315, 317, 320, 321, 309; 704/270, 271, 272, 275
See application file for complete search history.

(56) References Cited

U.S. PATENT DOCUMENTS

| | | | | |
|---|---|---|---|---|
| 3,894,195 | A * | 7/1975 | Kryter | 381/23.1 |
| 5,434,924 | A * | 7/1995 | Jampolsky | 381/23.1 |
| 6,795,807 | B1 * | 9/2004 | Baraff | 704/271 |
| 2008/0082327 | A1 | 4/2008 | Murase et al. | |

FOREIGN PATENT DOCUMENTS

| | | |
|---|---|---|
| JP | 6-245299 | 9/1994 |
| JP | 2005-268964 | 9/2005 |
| JP | 2006-87018 | 3/2006 |

OTHER PUBLICATIONS

International Search Report issued Dec. 6, 2011 in International (PCT) Application No. PCT/JP2011/005784.
Y. Suzuki et al., "Determination of filtering parameters for dichotic-listening binaural hearing aids", Acoustics '08, Paris (France), 2008.

* cited by examiner

*Primary Examiner* — Huyen D Le
(74) *Attorney, Agent, or Firm* — Wenderoth, Lind & Ponack, L.L.P.

(57) ABSTRACT

A hearing aid used for a low tone frequency band, a hearing aid used for a high tone frequency band, and a controller that compares sound pressure of the high tone frequency band split by a frequency band analyzer of the hearing aid used for the high tone frequency band with sound pressure of the high tone frequency band split by a frequency band analyzer of the hearing aid used for the low tone frequency band. If the sound pressure of the high tone frequency band of the hearing aid used for the low tone frequency band is higher by at least a specific amount than the sound pressure of the high tone frequency band of the hearing aid used for the high tone frequency band, the sound pressure of the high tone frequency band of the hearing aid used for the high tone frequency band is raised.

6 Claims, 13 Drawing Sheets

(a)

(b) Characteristics at left ear position (c) Characteristics at right ear position (a)

(b) Characteristics at left ear position (c) Characteristics at right ear position (d) Left ear (e) Right ear (a)

(b) Characteristics at left ear position (c) Characteristics at right ear position (d) Left ear (e) Right ear (a)

(b) Characteristics at left ear position (c) Characteristics at right ear position (d) Left ear (e) Right ear

HEARING AID DEVICE

TECHNICAL FIELD

The present invention relates to a hearing aid device.

BACKGROUND ART

Hearing aid devices developed for patients with hearing impairment use a gain controller to amplify the sound collected by a microphone, and output a loud sound from a speaker, which greatly improves the patient's sound recognition.

However, in processing that merely amplifies the sound collected by a microphone with a gain controller and outputs a loud sound from a speaker, the patient's hearing may still not be sufficiently improved, particularly when it comes to understanding conversation.

One reason for this is that speech is made up of vowels (low tones) and consonants (high tones). Specifically, most patients find it particularly hard to hear sounds in the high tone frequency band, that is, consonants, and this inability to hear consonants properly is believed to hinder a proper understanding of conversation.

One possible way to deal with this problem is to raise the amplification of the gain controller. However, when the amplification is raised, the sound pressure (the volume, or sound level) of vowels also increases, resulting in a state in which consonants end up being buried in these vowels (a masking state). As a result, there is the risk that the patient's hearing will not be sufficiently improved in terms of understanding conversation, as mentioned above.

In view of this, the following Non-Patent Literature 1 proposes that a first hearing aid worn on one ear function for low tone use, and that a second hearing aid worn on the other ear function for high tone use. That is, vowels in conversation are low tones and are therefore picked up by the first hearing aid, while consonants in conversation are high tones and are therefore picked up by the second hearing aid, and processing by the brain forms these into a single sound. Consequently, the user can hear conversation more easily.

CITATION LIST

Non-Patent Literature

Non-Patent Literature 1: Y. Suzuki et al., "Determination of filtering parameters for dichotic-listening binaural hearing aids," Acoustic 08, Paris (France), 2008.

SUMMARY

With the hearing aid device discussed in Non-Patent Literature 1, as mentioned above, the first hearing aid worn on one ear functions for low tone use (vowels), and the second hearing aid worn on the other ear functions for high tone use (consonants), which prevents the occurrence of masking by low tones (vowels) in the second hearing aid used for high tones (consonants). As a result, the user can hear conversation more clearly.

It is an object of the present invention to provide a hearing aid device that allows conversation to be heard more clearly, in order to eliminate the problem whereby a situation arises in which conversation is difficult to hear clearly even when a hearing aid device is used.

More specifically, it is an object of the present invention to eliminate the problem whereby a situation arises in which conversation is difficult to hear clearly when a person is speaking on the first hearing aid side, when the patient is wearing a first hearing aid for low tones (vowels) on one ear and wearing a second hearing aid for high tones (consonants) on the other ear. This situation, and the reason for its occurrence, will be described in detail in the following sections titled Advantageous Effects and Description of Embodiments.

The hearing aid device pertaining to the present invention comprises first and second hearing aids worn on the left and right ears, and a controller connected by wire or wirelessly to the first and second hearing aids. The first hearing aid includes a first microphone, a first frequency band analyzer that splits sound collected by the first microphone into a plurality of frequency bands, a first gain controller that performs gain control on the frequency bands split by the first frequency band analyzer, a first frequency band synthesizer that is connected to the first gain controller, and a first speaker that is connected to the first frequency band synthesizer. The second hearing aid includes a second microphone, a second frequency band analyzer that splits sound collected by the second microphone into a plurality of frequency bands, a second gain controller that performs gain control on the frequency bands split by the second frequency band analyzer, a second frequency band synthesizer that is connected to the second gain controller, and a second speaker that is connected to the second frequency band synthesizer. The second gain controller sets the gain with respect to a high tone frequency band split by the second frequency band analyzer to be higher than the gain with respect to a low tone frequency band, and makes the second hearing aid into a high tone frequency band-use hearing aid. The controller compares the sound pressure of the high tone frequency band split by the second frequency band analyzer of the second hearing aid with the sound pressure of the high tone frequency band split by the first frequency band analyzer of the first hearing aid, and if the sound pressure of the high tone frequency band of the first hearing aid is higher by at least a specific amount than the sound pressure of the high tone frequency band of the second hearing aid, the sound pressure of the high tone frequency band of the second hearing aid is raised.

ADVANTAGEOUS EFFECTS

With the hearing aid device of the present invention, consonant recognition, which is necessary for understanding conversation, is improved, and as a result the user can hear conversation more clearly.

DESCRIPTION OF EMBODIMENTS

Embodiments of the present invention will now be described through reference to the drawings.

Embodiment 1

Figure 1:
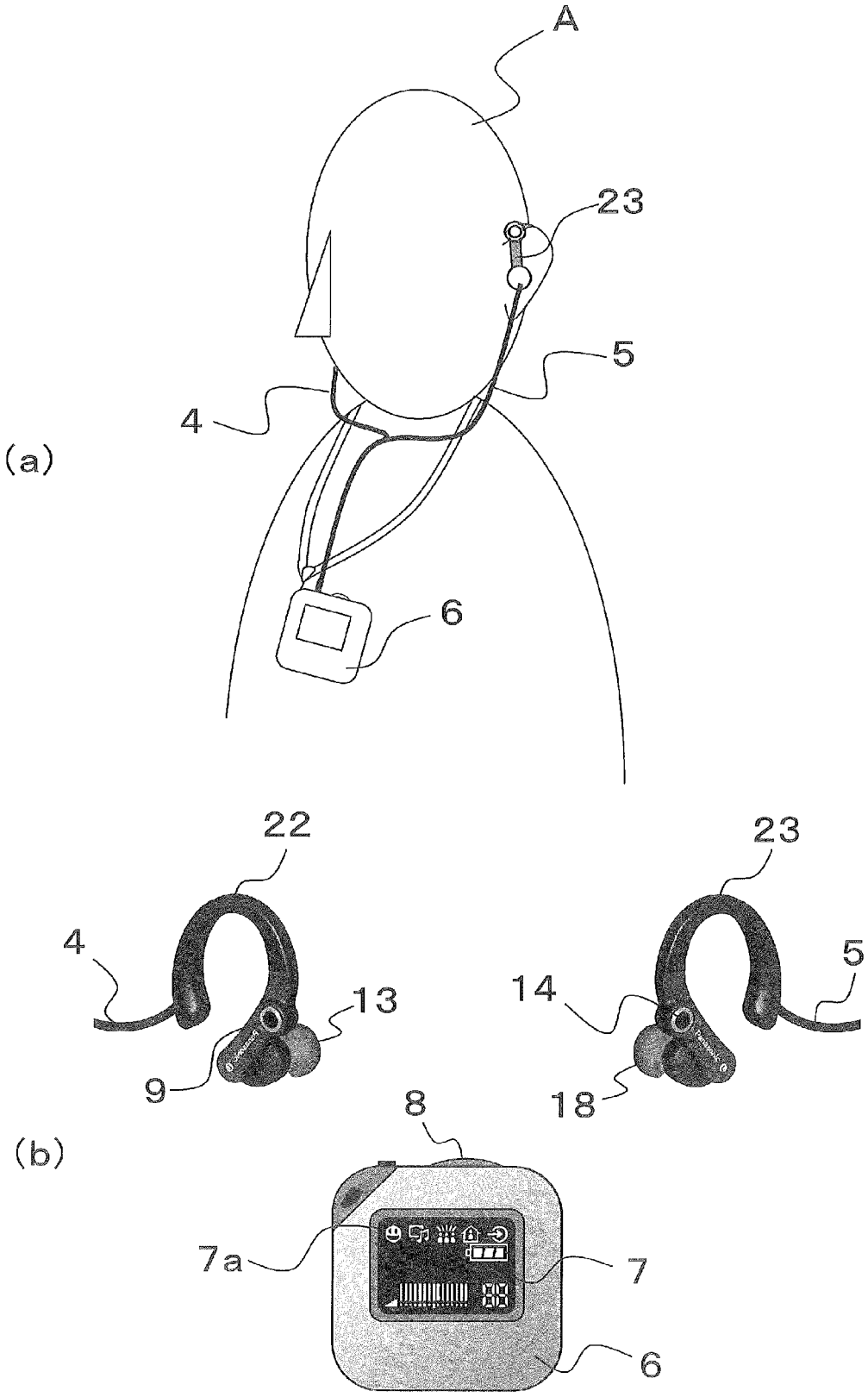
FIGS. 1(*a*) and 1(*b*) show the configuration of the hearing aid device pertaining to an embodiment of the present invention.

FIGS. 1(*a*) and 1(*b*) show the hearing aid device 1 of this embodiment.

As shown in FIGS. 1(*a*) and 1(*b*), the hearing aid device 1 comprises a sound input/output device 22 that is worn on the right ear of a user A, a sound input/output device 23 that is worn on the left ear, and a signal processor 6 that is electrically connected to the sound input/output devices 22 and 23 via lead wires 4 and 5.

The signal processor 6 comprises a display component 7 and a switch 8 for switching functions (discussed below).

Figure 2:
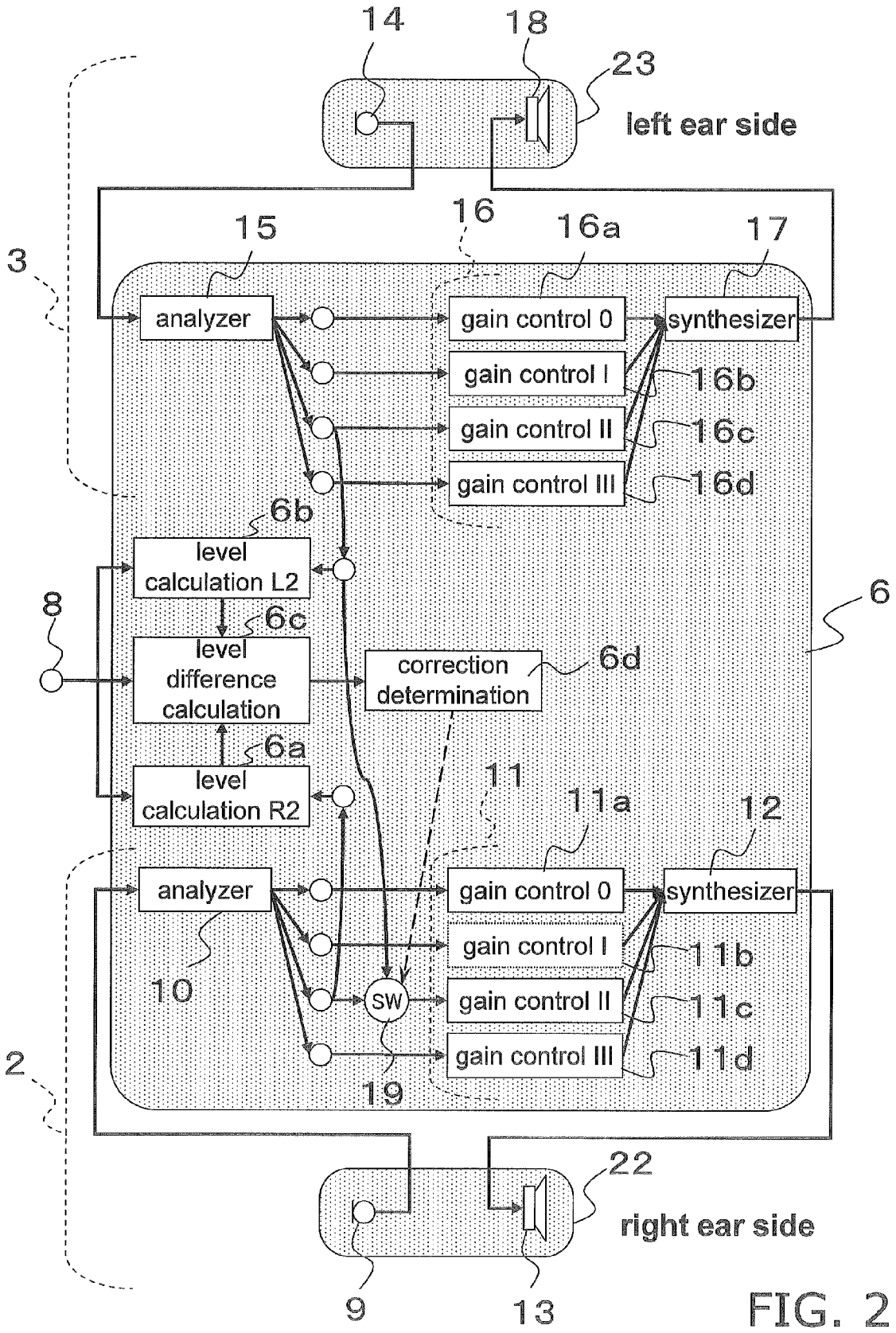
FIG. 2 is a control block diagram of the hearing aid device in FIG. 1.

FIG. 2 shows the electrical control blocks of the hearing aid device 1.

The sound input/output device 22 worn on the right ear has a right ear microphone 9 and a right ear speaker 13. The sound input/output device 23 worn on the left ear has a left ear microphone 14 and a left ear speaker 18.

The signal processor 6 has a frequency band analyzer 10, a gain controller 11, and a frequency band synthesizer 12 on the right ear side, and a frequency band analyzer 15, a gain controller 16, and a frequency band synthesizer 17 on the left ear side.

The frequency band analyzer 10 splits sound collected by the right ear microphone 9 into four frequency bands.

The gain controller 11 performs gain control on the frequency bands split by the frequency band analyzer 10.

The frequency band synthesizer 12 is connected to the gain controller 11.

The frequency band analyzer 15 splits sound collected by the left ear microphone 14 into four frequency bands.

The gain controller 16 performs gain control on the frequency bands split by the frequency band analyzer 15.

The frequency band synthesizer 17 is connected to the gain controller 16.

Figure 3:
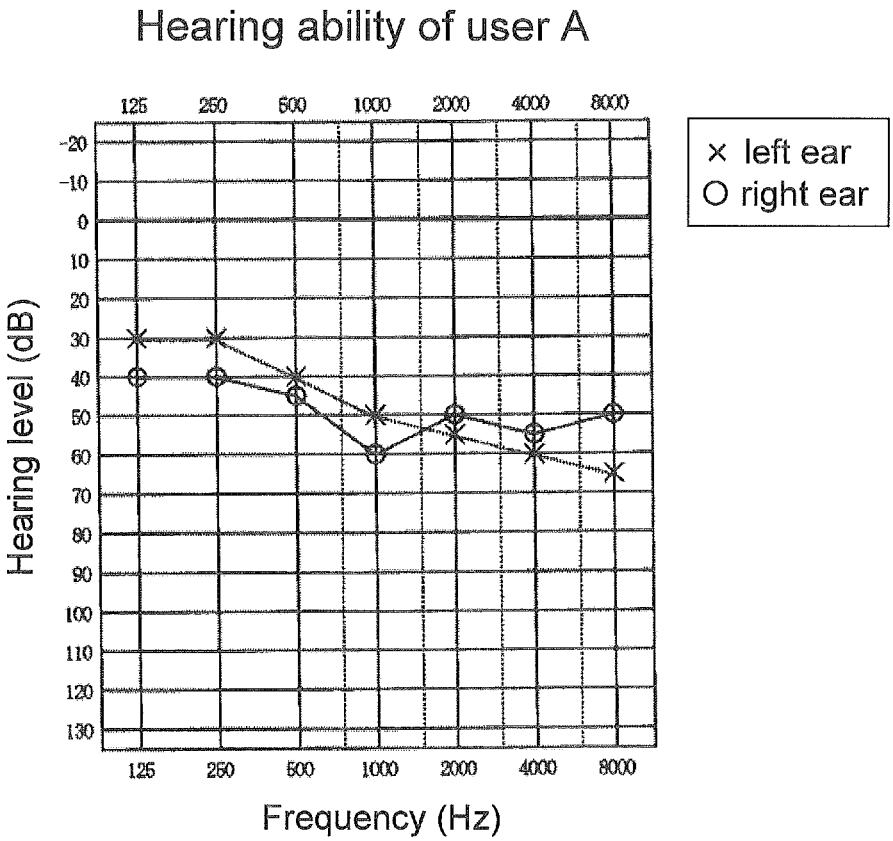
FIG. 3 is a graph of an example of the hearing acuity of a user of the hearing aid device in FIG. 1.

FIG. 3 shows the hearing acuity of the user A.

With the user A, the hearing acuity in the high tone frequency band is inferior to that in the low tone frequency band, and the hearing acuity of the left ear in the high tone frequency band is inferior to that of the right ear. Accordingly, fitting of the hearing aids is performed so as to attain the frequency-gain relation shown in FIG. 4.

As shown in FIG. 2, one feature of the hearing aid device 1 of this embodiment is that sound collected by the right ear microphone 9 provided to the sound input/output device 22 worn on the right ear is split into four frequency bands by the frequency band analyzer 10 in the signal processor 6.

Figure 4:
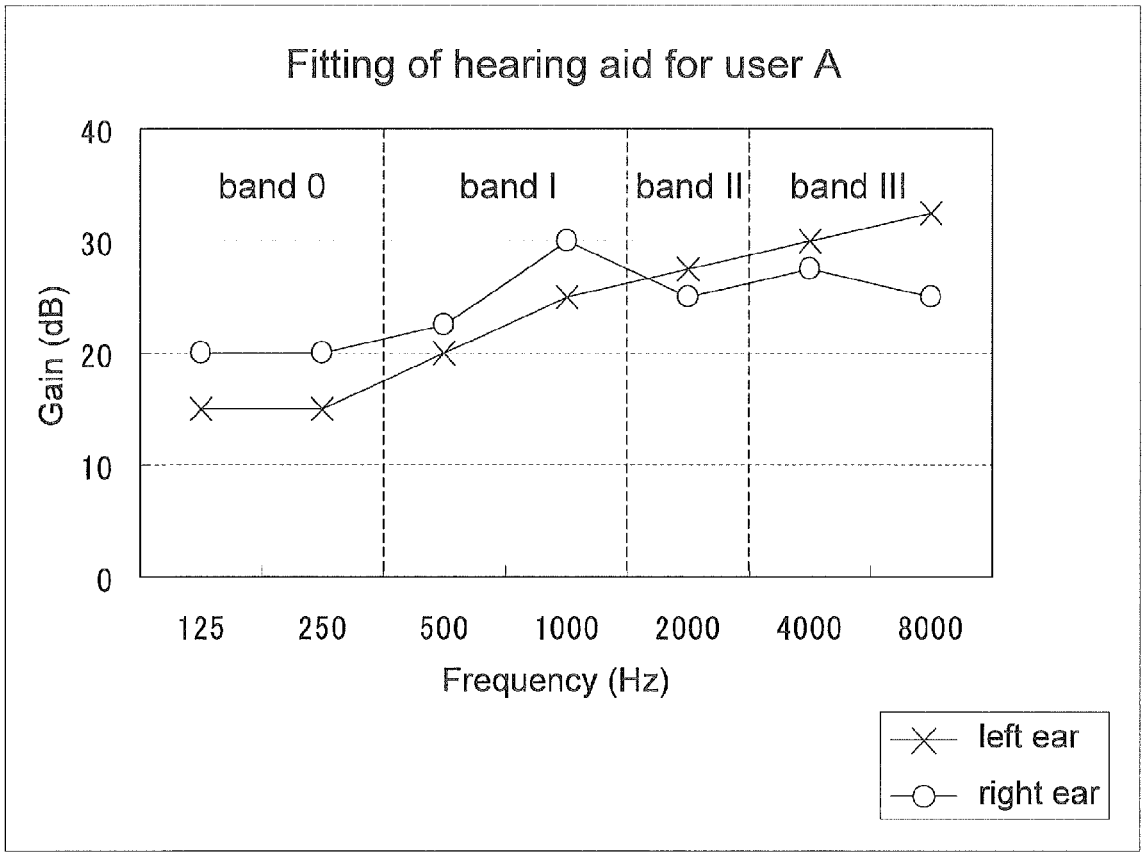
FIG. 4 is a graph of an example of fitting data for the hearing aid device in FIG. 1.

The four frequency bands in the example shown in FIG. 4 are a frequency band 0 of 300 Hz or less, a frequency band I of more than 300 Hz and no more than 1250 Hz, a frequency band II of more than 1250 Hz and no more than 3000 Hz, and a frequency band III of more than 3000 Hz.

Sounds in each frequency band are amplified by gain control components 11*a*, 11*b*, 11*c*, and 11*d* that make up the gain controller 11, after which they are composed by the frequency band synthesizer 12. A signal of this composition result is supplied to the right ear speaker 13 provided to the sound input/output device 22.

With the hearing aid device 1 in this embodiment, a right ear hearing aid 2 is made up of the above-mentioned processing blocks.

Similarly, as shown FIG. 2, sound collected by the left ear microphone 14 provided to the sound input/output device 23 worn on the left ear is split into four frequency bands (for example, a frequency band 0 of 300 Hz or less, a frequency band I of no more than 1250 Hz, a frequency band II of no more than 3000 Hz, and a frequency band III of more than 3000 Hz, as shown in FIG. 4) by the frequency band analyzer 15 in the signal processor 6.

Sounds in each frequency band are amplified by gain control components 16*a*, 16*b*, 16*c*, and 16*d* that make up the gain controller 16, after which they are composed by the frequency band synthesizer 17. A signal of this composition result is supplied to the left ear speaker 18 provided to the sound input/output device 23.

With the hearing aid device 1 in this embodiment, a left ear hearing aid 3 is made up of the above-mentioned processing blocks.

Therefore, the fitting data shown in FIG. 4 is supplied to the gain controller 11 used for the right ear and to the gain controller 16 used for the left ear.

More specifically, of the right ear fitting data, that in frequency band 0 is supplied to the gain control component 11*a*, that in frequency band I is supplied to the gain control component 11*b*, that in frequency band II is supplied to the gain control component 11*c*, and that in frequency band III is supplied to the gain control component 11*d*, and the gain is set.

Similarly, of the left ear fitting data, that in frequency band 0 is supplied to the gain control component 16*a*, that in frequency band I is supplied to the gain control component 16*b*, that in frequency band II is supplied to the gain control component 16*c*, and that in frequency band III is supplied to the gain control component 16*d*, and the gain is set.

Figure 5:
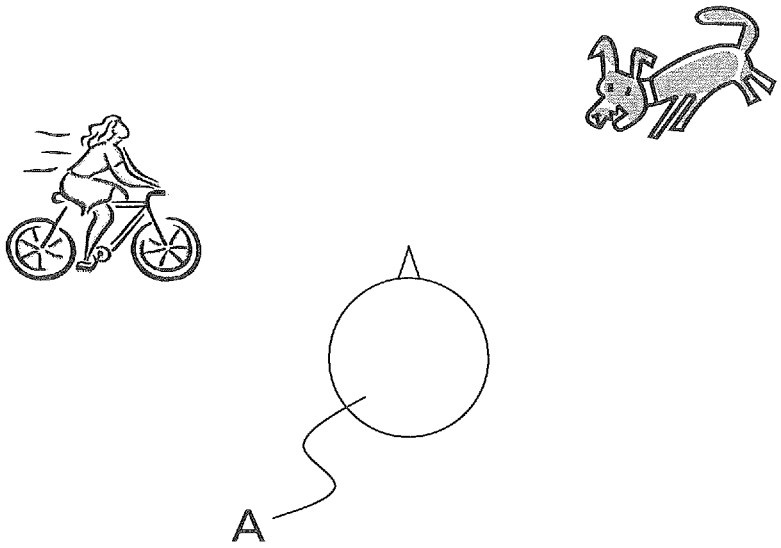
FIG. 5 shows a usage situation for the hearing aid device in FIG. 1.

As shown in FIG. 5, when the user A is walking along a street, stereo hearing compensation is performed just as with an ordinary hearing aid device. Specifically, sound collected by the right ear microphone 9 and sound collected by the left ear microphone 14 are amplified for each frequency band according to the frequency-gain relation shown in FIG. 4, and are outputted from the right ear speaker 13 and the left ear speaker 18, respectively.

Figure 6:
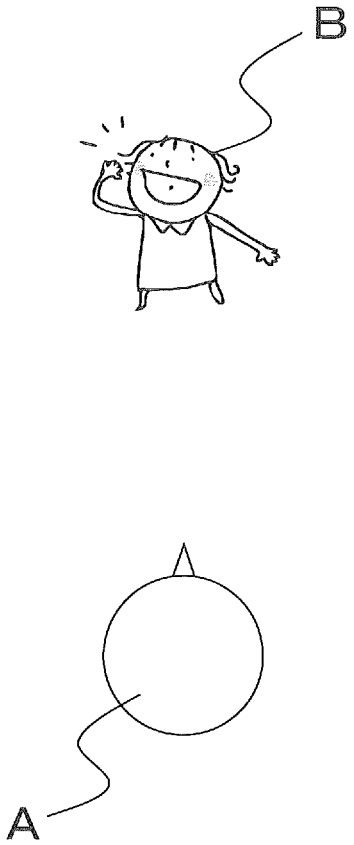
FIG. 6 shows a usage situation for the hearing aid device in FIG. 1.

In contrast, FIG. 6 shows the situation in which the user A is conversing with a person B.

Figure 7:
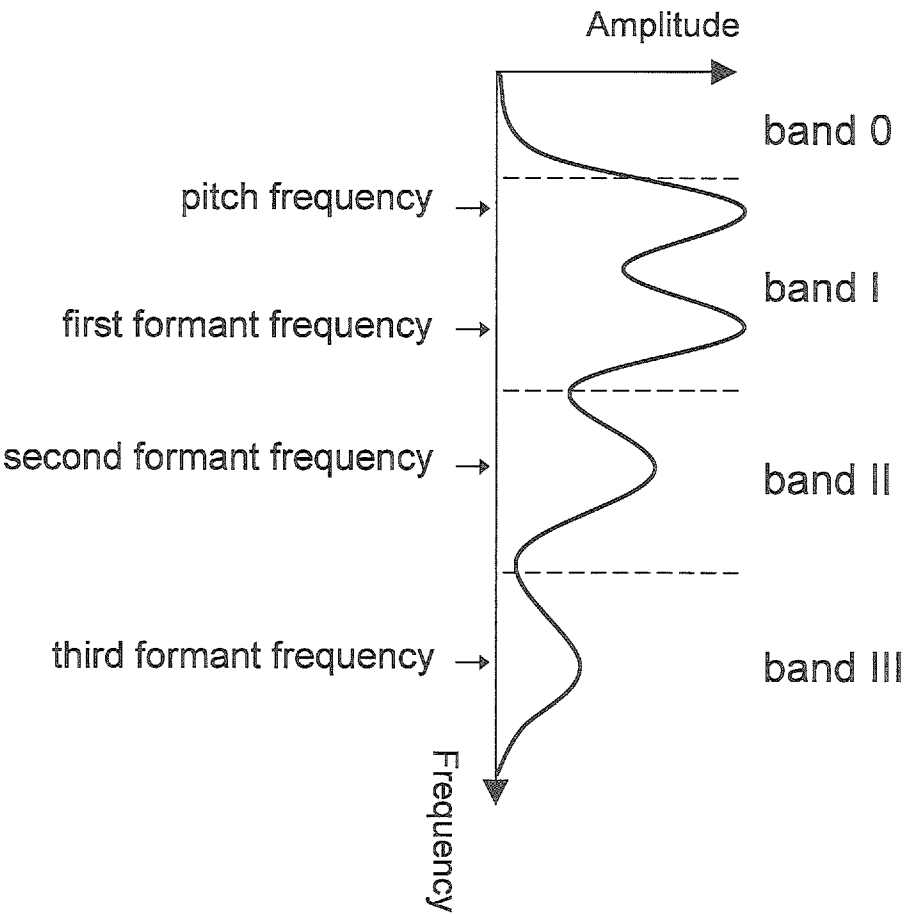
FIG. 7 is a graph of speech characteristics with the hearing aid device in FIG. 1.

As shown in FIG. 7, a feature of speech during conversation is that there are sound components in a wide region from frequency band 0 to frequency band III. In particular, a vowel component is present in the low tone frequency band (frequency bands 0 and I), and more consonant components are present in the high tone frequency band (frequency bands II and III, and particularly frequency band II).

Most users of the hearing aid device 1, including the user A, view smoothly conversing as being extremely important, and to this end, it is important to clearly hear the words uttered by the person B.

Most users of the hearing aid device 1, including the user A, have poor hearing in the high tone frequency band, as indicated by the hearing acuity data in FIG. 3. When hearing is thus poor in the high tone frequency band, recognition of consonant components present in the high tone frequency band shown in FIG. 7 (and particularly frequency band II out of frequency bands II and III) ends up being low. As a result, there is the risk that the user will not clearly hear a conversation.

In view of this, with this embodiment, during conversation the user A presses the switch 8 provided to the signal processor 6 shown in FIG. 1. When the switch 8 is pressed, a conversation indicator 7*a* is lit on the display component 7 shown in FIG. 1, so the user can tell that the system has been switched to conversation-use control.

Figure 8:
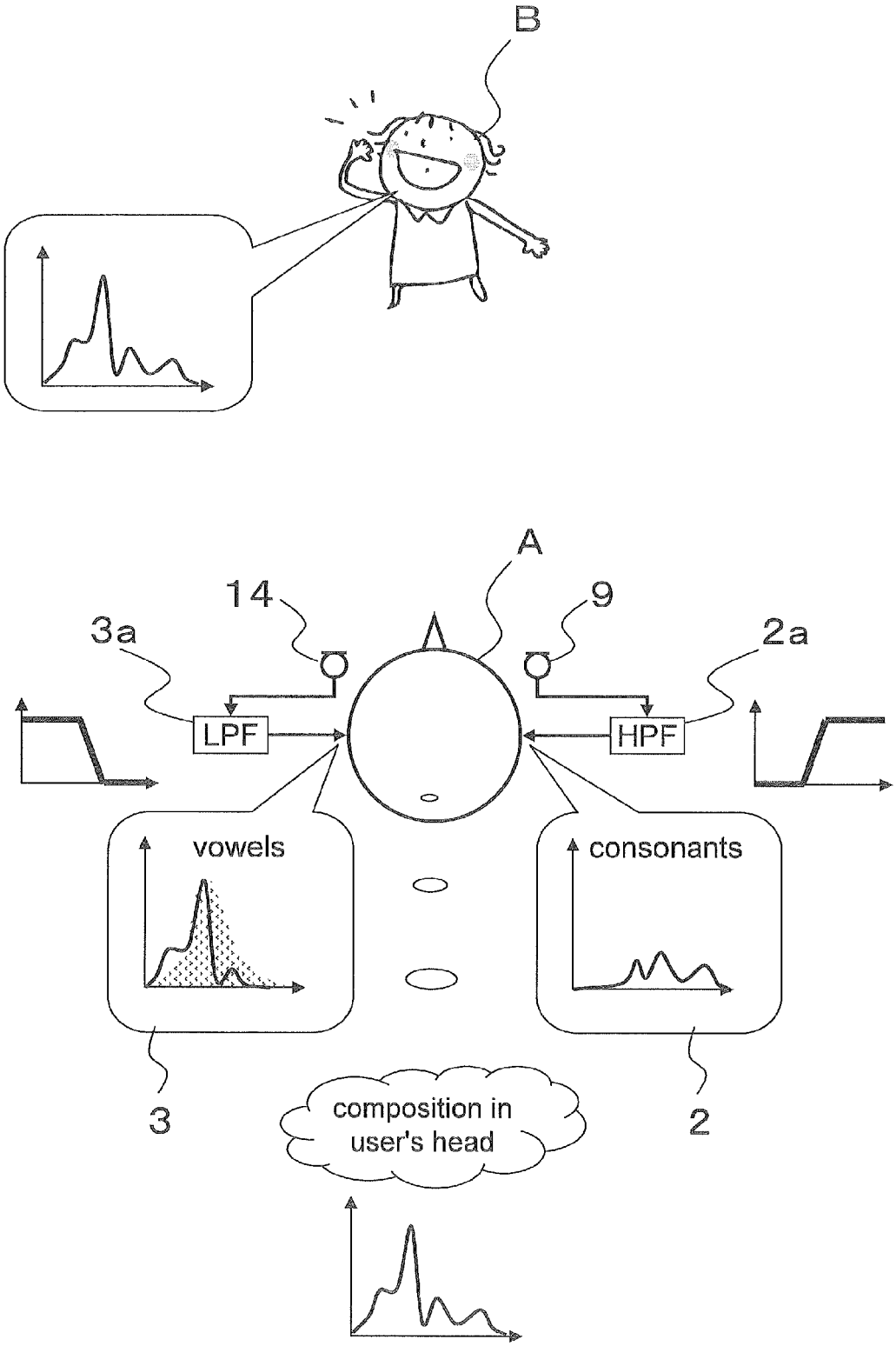
FIG. 8 shows how the user of the hearing aid device in FIG. 1 hears speech.

With this embodiment, when the switch 8 is pressed to switch to conversation-use control, as shown in FIG. 8, the right ear hearing aid 2 is used for consonants and the left ear hearing aid 3 for vowels.

As shown in FIG. 3, the user A has better hearing in the high tone frequency band with the right ear than with the left ear, so the right ear hearing aid 2 is set for consonant use and the left ear hearing aid 3 for vowel use as discussed above.

When the switch 8 is pressed, the right ear hearing aid 2 used for consonants lowers the amplification of the gain controller 11*a* and the gain controller 11*b* shown in FIG. 2, for the fitting characteristics shown in FIG. 4. Conversely, the left ear hearing aid 3 used for vowels lowers the amplification of the gain controller 16*c* and the gain controller 16*d* shown in FIG. 2.

That is, as shown in FIG. 8, this state is the same as when a high-pass filter 2*a* is interposed at the right ear hearing aid 2 used for consonants, when a low-pass filter 3*a* is interposed at the left ear hearing aid 3 used for vowels. As a result, the user A hears vowels with the left ear, hears consonants with the right ear, and brain processing composes these vowels and consonants so that the user can clearly hear the conversation.

In this embodiment, the amplification was set for the hearing aids 2 and 3 of both ears as above, but the present invention is not limited to this. The effect of the present invention can be obtained as long as the amplification of one hearing aid with respect to the high tone frequency band is set higher than the amplification with respect to the low tone frequency band, and the other hearing aid is made to function as a hearing aid for consonants (for the high tone frequency band).

Figure 9:
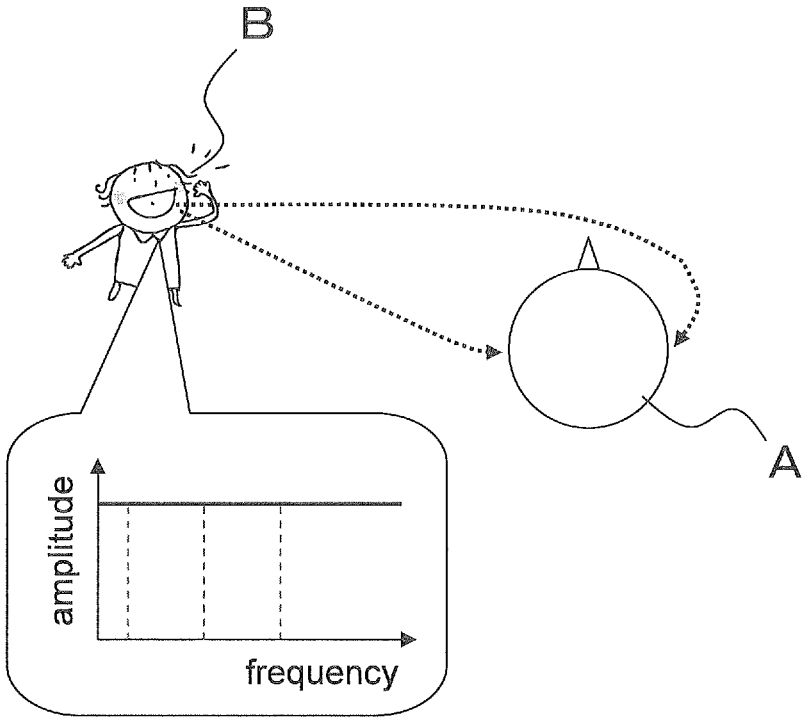
FIGS. 9(*a*) to 9(*c*) show how the user of the hearing aid device in FIG. 1 hears speech.
Figure 9:
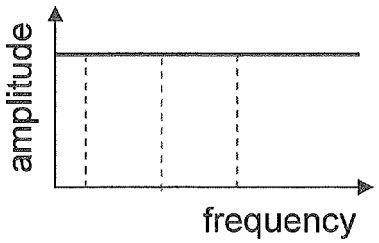
Figure 9:
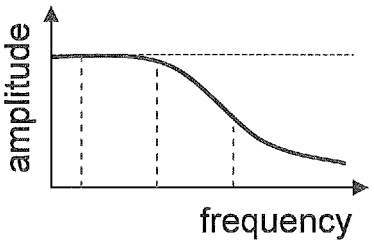

As shown in FIGS. 9(*a*) to 9(*c*), in this embodiment, consonants will end up being difficult to hear if the person B moves to the left ear side of the user A.

More specifically, if the person B moves to the left side of the user A as shown in FIG. 9(*a*), the conversation sounds attain the same level from the low tone frequency band to the high tone frequency band at the left ear microphone 14. However, as shown in FIG. 9(*c*), the level on the high tone frequency band side ends up being lower at the right ear microphone 9.

In other words, of the conversation of the person B located on the left ear side of the user A, the low tone frequency band component has a low frequency and therefore goes around to the right ear microphone 9 as well, so an adequate level can be maintained. On the other hand, the high tone frequency band component has a high frequency and therefore has high rectilinearity and cannot adequately reach the right ear microphone 9. As a result, as shown in FIG. 9(*c*), the level of the high tone frequency band (consonant frequency band) ends up dropping at the right ear microphone 9.

In this case, as discussed above, since the right ear hearing aid 2 is set so that the user can hear consonants, it will be difficult to hear consonants if high tones (consonants) of an adequate level do not reach the right ear microphone 9, so a problem is that the user cannot hear a conversation clearly.

In view of this, with the hearing aid device 1 in this embodiment, as discussed above, the instant the switch 8 is pressed, control is performed so that level calculators 6*a* and 6*b*, a level difference calculator 6*c*, and a correction determination component 6*d* that constitute the signal processor 6 shown in FIG. 2 are driven.

The level calculator 6*a* calculates the sound pressure (sound level, volume) of frequency band II (consonant frequency band) split by the frequency band analyzer 10.

The level calculator 6*b* calculates the sound pressure of frequency band II (consonant frequency band) split by the frequency band analyzer 15.

The level difference calculator 6*c* calculates which of the level calculators 6*a* and 6*b* has a higher sound pressure, and by how much.

If the correction determination component 6*d* determines that the sound pressure of the level calculator 6*b* is greater by at least a specific amount (more specifically, at least 6 dB) than the sound pressure of the level calculator 6*a*, then of the sound collected by the left ear microphone 14, the sound in frequency band II (consonant frequency band) is supplied to the right ear gain controller 11*c* via a switching means 19. Consequently, the sound pressure of the high tone frequency band of the right ear hearing aid 2 is raised to the sound pressure of the high tone frequency band of the left ear hearing aid 3.

At this point, of the sound collected by the right ear microphone 9 that had originally been supplied to the gain controller 11*c*, the sound of frequency band II (consonant frequency band) is not supplied to the gain controller 11*c*.

Figure 10:
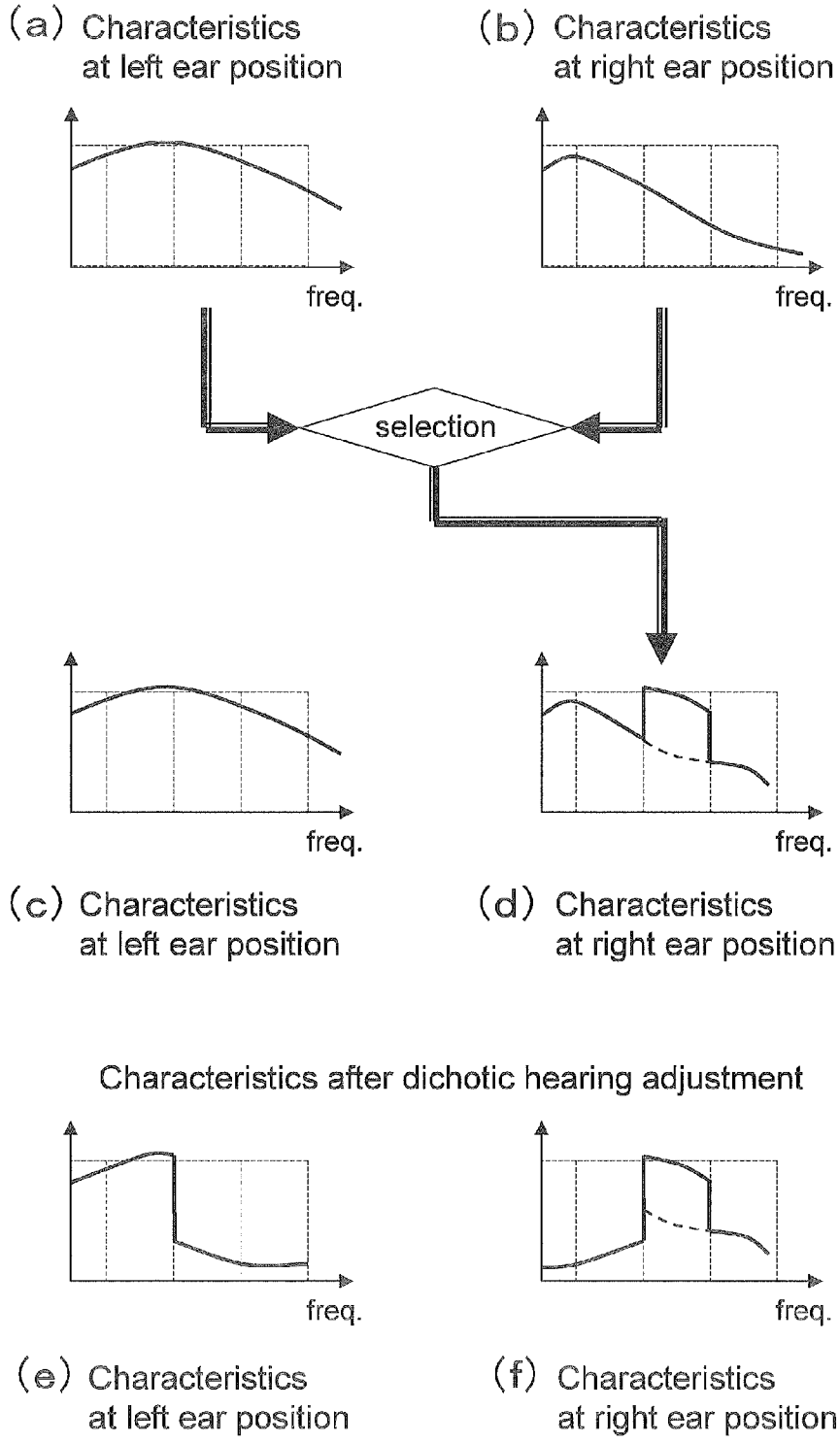
FIGS. 10(*a*) to 10(*f*) show how the user of the hearing aid device in FIG. 1 hears speech.

This state is depicted schematically in FIG. 10.

FIG. 10(*a*) shows the sound collected by the left ear microphone 14, and FIG. 10(*b*) shows the sound collected by the right ear microphone 9. As is clear from a comparison of these two, in the above-mentioned situation shown in FIG. 9, an adequate level of high tones (consonants) does not reach the right ear microphone 9, which is supposed to be collecting consonant sounds.

In view of this, in this embodiment, as discussed above, if there is a difference between the sound pressure of the right ear level calculator 6*a* and the sound pressure of the left ear level calculator 6*b*, the system calculates which is higher and by how much.

In the state shown in FIG. 9, as discussed above, the correction determination component 6*d* determines that the sound pressure of the left ear level calculator 6*b* is greater by at least a specific amount (more specifically, at least 6 dB) than the sound pressure of the right ear level calculator 6*a*. Accordingly, of the sound captured by the left ear microphone 14, the sound of frequency band II (consonant frequency band) is supplied through the switching means 19 to the right ear gain controller 16*c*. As a result, as shown in FIG. 10*d*, a sound signal supplied to the right ear gain controller 11 is in a state in which the sound component of frequency band II (consonant frequency band) has been built up.

However, in this embodiment, as discussed above, when the switch 8 is pressed, the right ear gain controller 11 used for consonants is in a state in which the amplification of the gain controllers 11*a* and 11*b* shown in FIG. 2 has been lowered. Accordingly, the sound signal of FIG. 10(*f*) is supplied to the frequency band synthesizer 12 used for the right ear (for consonants), and this is supplied to the right ear speaker 13.

Meanwhile, the sound signal in FIG. 10(*c*) is supplied to the left ear gain controller 16 of the left ear used for vowels.

When the switch 8 is pressed as discussed above, a state results in which the amplification of the gain controller 16*c* and the gain controller 16*d* is lowered. Accordingly, the sound signal in FIG. 10(*e*) is supplied to the frequency band synthesizer 17 used for the left ear (for vowels), and this is supplied to the left ear speaker 18.

That is, in this embodiment, even when consonants of sufficient sound pressure do not reach the right ear microphone 9, as long as consonants of sufficient sound pressure reach the left ear microphone 14, the consonant sounds collected by the left ear microphone 14 can be supplied to the right ear hearing aid 2 that has been set so that consonants can be heard, so the user can hear conversation clearly.

Figure 11:
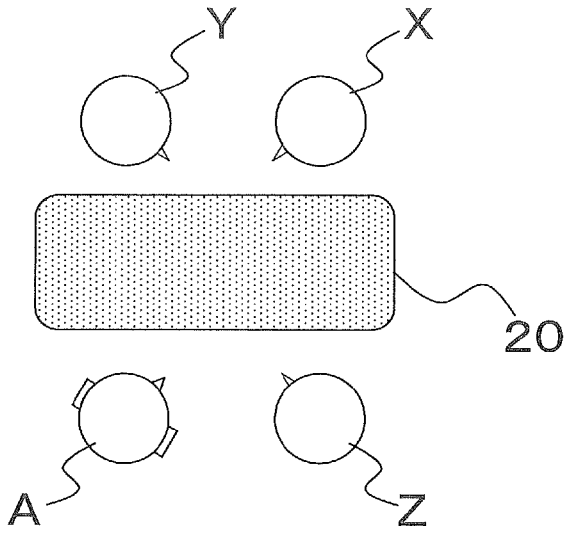
FIGS. 11(*a*) to 11(*e*) show how the user of the hearing aid device in FIG. 1 hears speech.
Figure 11:
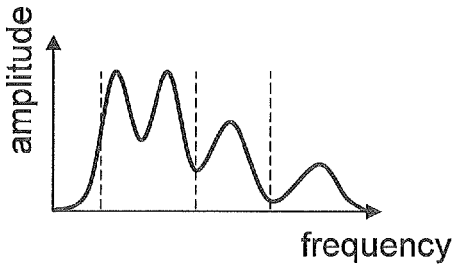
Figure 11:
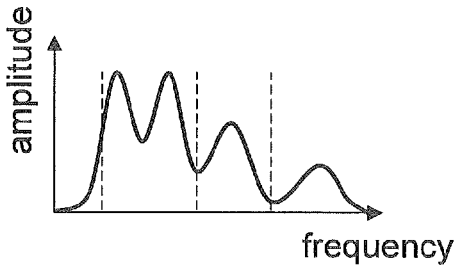
Figure 11:
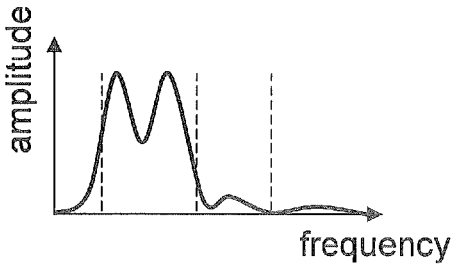
Figure 11:
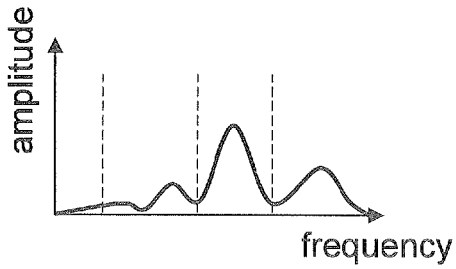

Therefore, as shown in FIG. 11(*a*), for example, when a group of four consisting of the user A, a person X, a person Y, and a person Z are enjoying a conversation around a table 20, the user A wearing the hearing aid device 1 can clearly hear the conversation of the person X, the person Y, and the person Z sitting in various directions with respect to the user A. Thus, the user A can smoothly converse with the person X and the others.

FIGS. 11(*a*) to 11*e* show the state when the user A is listening to the person X sitting directly in front of the user A.

Since the state here is the same as that in FIGS. 6 and 8, the sound pressure collected by the left ear microphone 14 and the sound pressure collected by the right ear microphone 9 are in the same state, as shown in FIGS. 11(*b*) and 11(*c*). Therefore, a vowel sound signal is issued from the left ear speaker 18 as shown in FIG. 11(*d*), a consonant sound signal is issued from the right ear speaker 13 as shown in FIG. 11(*e*), and these are composed by processing of the brain, which allows the conversation to be heard clearly.

Figure 12:
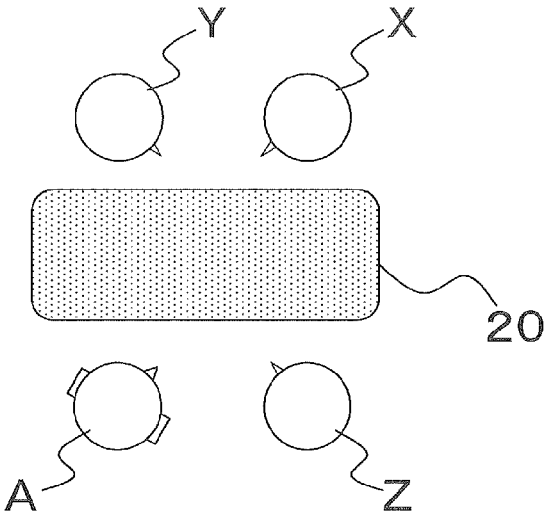
FIGS. 12(*a*) to 12(*e*) show how the user of the hearing aid device in FIG. 1 hears speech.
Figure 12:
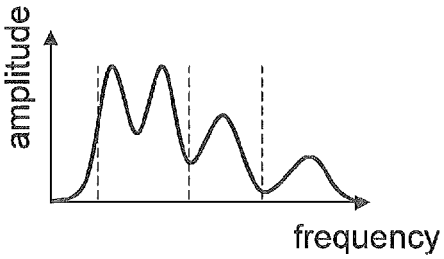
Figure 12:
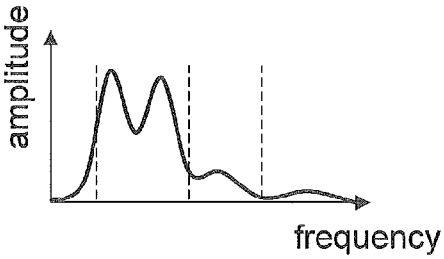
Figure 12:
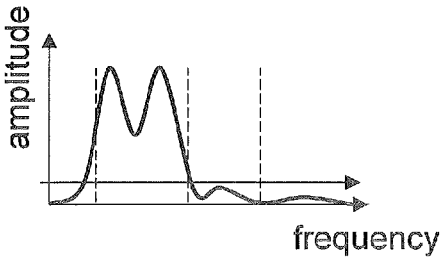
Figure 12:
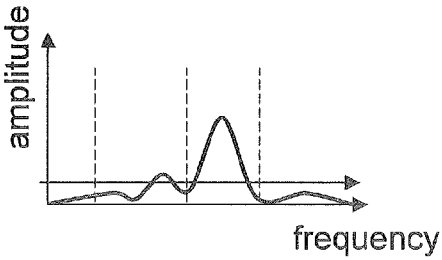

Next, FIGS. 12(*a*) to 12(*e*) show the state when the user A is listening to the conversation of the person Y sitting to the left of the user A.

Since the state here is the same as that in FIG. 9, in this state sound in frequency band II (consonant frequency band) collected by the left ear microphone 14 has a sound pressure that is at least 6 dB, for example, greater than that of the sound in frequency band II (consonant frequency band) collected by the right ear microphone 9, as shown in FIGS. 12(*b*) and 12(*c*).

Therefore, with the hearing aid device 1 of this embodiment, a vowel sound signal is issued from the left ear speaker 18 as shown in FIG. 12(*d*), and a sound signal of a state in which consonant sounds collected by the left ear microphone 14 have been sent around is issued from the right ear speaker 13 as shown in FIG. 12(*e*). Consequently, the user A can hear the conversation clearly because of composition by the user's brain processing.

Figure 13:
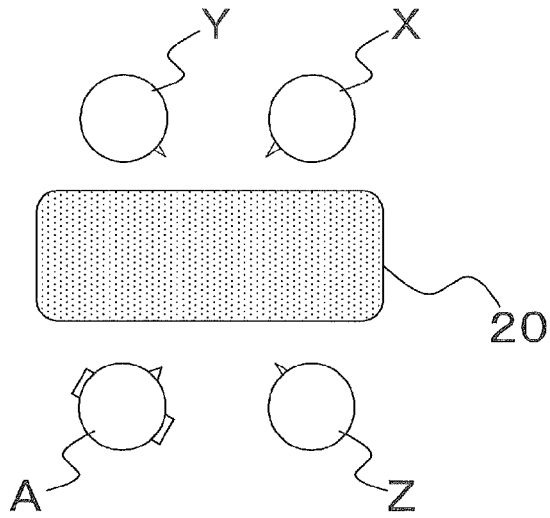
FIGS. 13(*a*) to 13(*e*) show how the user of the hearing aid device in FIG. 1 hears speech.
Figure 13:
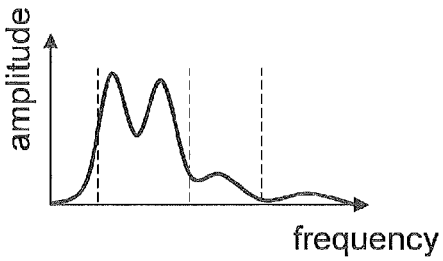
Figure 13:
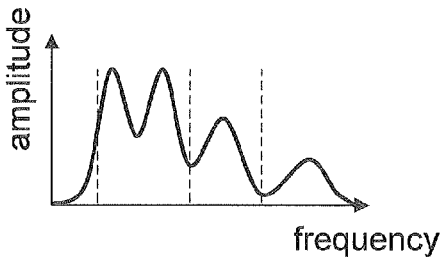
Figure 13:
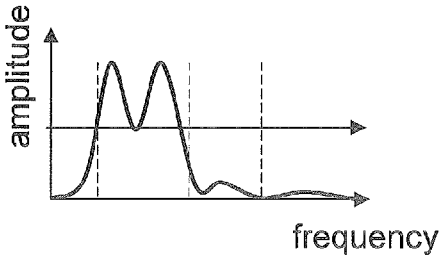
Figure 13:
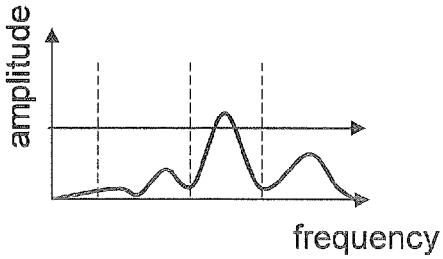

Next, FIGS. 13(*a*) to 13(*e*) show a state in which the user A is listening to the conversation of the person Z sitting to the right of the user A.

As shown in FIG. 13(*c*), a sound signal for consonants with a sufficient level can be collected by the right ear microphone 9 here. Meanwhile, as shown in FIG. 13(*b*), since a sound signal for vowels in the low tone frequency band can be sufficiently collected by the left ear microphone 14, the conversation can be heard clearly.

In this embodiment, an example was described in which control is performed such that the signal processor 6 compares the sound pressure of the high tone frequency band split by the frequency band analyzer 10 of the right ear hearing aid 2 that is used for the high tone frequency band, with the sound pressure of the high tone frequency band split by the frequency band analyzer 15 of the left ear hearing aid 3 that is used for the low tone frequency band, and if the sound pressure of the high tone frequency band of the left ear hearing aid 3 used for the low tone frequency band is determined to be higher by at least a specific amount than the sound pressure of the high tone frequency band of the right ear hearing aid 2 used for the high tone frequency band, then the sound signal for the high tone frequency band of the left ear hearing aid 3 used for the low tone frequency band is inputted to the gain controller 11*c* used for the high tone frequency band of the gain controller 11 of the right ear hearing aid 2 that is used for the high tone frequency band. However, the present invention is not limited to this.

For example, control may be performed such that if the sound pressure of the high tone frequency band of the left ear hearing aid 3 used for the low tone frequency band is higher by at least a specific amount than the sound pressure of the high tone frequency band of the right ear hearing aid 2 used for the high tone frequency band, then the sound pressure of the high tone frequency band of the right ear hearing aid 2 used for the high tone frequency band is raised to about the same as the sound pressure of the high tone frequency band of the left ear hearing aid 3 used for the low tone frequency band.

Specifically, the effect of the present invention can be obtained the same as with the constitution described in this embodiment by controlling the system so that the difference between the sound pressure of the high tone frequency band of the right ear hearing aid 2 used for the high tone frequency band and the sound pressure of the high tone frequency band of the left ear hearing aid 3 used for the low tone frequency band is close to zero.

Furthermore, part of this control in the above embodiment may be modified as follows.

For example, signal processor 6 compares the sound pressure of the high tone frequency band split by the frequency band analyzer 10 of the right ear hearing aid 2 that is used for the high tone frequency band, with the sound pressure of the high tone frequency band split by the frequency band analyzer 15 of the left ear hearing aid 3 that is used for the low tone frequency band, and if the sound pressure of the high tone frequency band of the left ear hearing aid 3 used for the low tone frequency band is higher by at least a specific amount than the sound pressure of the high tone frequency band of the right ear hearing aid 2 used for the high tone frequency band, then the amplification of the gain controller 11 of the right ear hearing aid 2 that is used for the high tone frequency band may be set to a higher amplification than the amplification calculated on the basis of the hearing characteristics of the hearing aid user (that is, the fitting characteristics in FIG. 4).

Other Modification Examples

The present invention was described on the basis of the above embodiment, but the present invention is not, of course, limited to or by the above embodiment. The following situations are also encompassed by the present invention.

(1)

The hearing aid device of the present invention may be constituted as a computer system made up of a microprocessor, a ROM, a RAM, a hard disk unit, a display unit, a keyboard, a mouse, and so forth.

More specifically, a computer program is stored in the RAM or the hard disk unit, and the microprocessor operates according to the computer program, so that the system functions as the above-mentioned hearing aid device.

The computer program here comprises a plurality of command codes that indicate commands to the computer in order for a specific function to be achieved.

(2)

Some or all of the constituent elements that make up the hearing aid device of the present invention may be constituted by a single system LSI (large scale integration) chip.

A system LSI chip is a super-multi-function LSI chip manufactured by integrating a plurality of constituent components on a single chip, and more specifically is a computer system that includes a microprocessor, a ROM, a RAM, and so forth. A computer program is stored in the RAM.

The microprocessor operates according to the computer program, allowing the system LSI chip to achieve various functions as the above-mentioned hearing aid device 1.

(3)

Some or all of the constituent elements that make up the hearing aid device of the present invention may be constituted by an IC card or a unit module that can be attached to and removed from a hearing aid device.

An IC card or module is a computer system that includes a microprocessor, a ROM, a RAM, and so forth. The IC card or module may be configured so as to include the above-mentioned super-multi-function LSI chip.

The microprocessor operates according to the computer program, allowing the IC card or module to achieve various functions as the above-mentioned hearing aid device 1.

The IC card or module may also be made tamper resistant.

(4)

The present invention may also be worked as a hearing aid processing method that is executed by the above-mentioned hearing aid device 1. The present invention may also be worked as a computer program with which this hearing aid processing method is carried out by a computer, or may be worked as a digital signal consisting of a computer program.

The present invention may also be worked as the recording of a computer program or a digital signal to a recording medium that can be read by a computer.

Examples of recording media that can be read by a computer include a flexible disk, a hard disk, a CD-ROM, an MO disk, a DVD, a DVDROM, a DVD-RAM, a BD (Blu-Ray Disc), and a semiconductor memory. The present invention may also be worked as a digital signal recorded to one of these recording media.

The present invention may also be worked as the transfer of a computer program or a digital signal via an electrical communications line, a wired or wireless communications line, a network (such as the Internet), data broadcast, or the like.

The present invention may also be worked as a computer system comprising a microprocessor and a memory, in which the memory stores the above-mentioned computer program, and the microprocessor operates according to the computer program.

A mode for working the present invention may also be employed, involving another independent computer system, by recording and transferring a program or a digital signal to a recording medium, or by transferring a program or a digital signal via a network or the like.

(5)

In the above embodiment, an example was given of the hearing aid device 1 that included the right and left hearing aids 2 and 3 connected via the lead wires 4 and 5, but the present invention is not limited to this.

For example, the present invention an also be applied to a hearing aid that can communicate wirelessly between hearing aids worn on the left and right ears.

For example, the constitution may be such that the signal processor 6 is installed in the right hearing aid, a speech signal inputted from a microprocessor is installed in the left hearing aid is transferred wirelessly to the right hearing aid, speech processing is performed as described in Embodiment 1 above in the right hearing aid, and then the left-side speech signal that has undergone speech processing is transferred wirelessly to the left hearing aid.

Further, the constitution may be such that a signal processor 6 is installed in both the right hearing aid and the left hearing aid, wireless communication is performed to convey the sound pressure level of the high tone frequency band (consonants) detected by each of the hearing aids, and if the sound pressure level on the hearing aid side assigned for consonants is low, then the sound pressure level of the high tone frequency band (consonants) thereof is raised.

(6)

Depending on the hearing impairment characteristics of the patient, if the speech signal inputted from the microphone is at a sufficient sound pressure level, there may be no need for the output to be divided up into vowels and consonants. In view of this, the function of dividing up the output into vowels and consonants may be switched on or off according to the input level from the microphone.

(7)

If there is no conversation and the ambient noise level is high, or if noise from a narrow frequency band is generated from one side, there is the risk that the user's sense of direction will be lost if the output is divided up into a high tone frequency band and a low tone frequency band.

In view of this, when there is no speech and there is ambient noise, the function of dividing up the output into the low tone frequency band (vowels) and the high tone frequency band (consonants) may be inactivated.

(8)

Even with a patient who can usually hear speech without having the output divided up into vowels and consonants, there may be situations in which there is a sudden drop in clarity and speech cannot be heard, such as when the ambient noise level is high, or when there is a high level of reverberant sound.

In view of this, a function may be provided for automatically activating the function of dividing up the output into vowels and consonants when ambient noise or reverberant sound is detected.

(9)

Also, in the above embodiment a function of dividing into vowels and consonants was described for the Japanese language, but the present invention is not limited to this.

The frequency band which characterize speech varies greatly from one language to the next. For example, the frequency band in Japanese ranges from 125 to 1500 Hz, but ranges from 2000 to 16,000 Hz with British English, and from 1000 to 4000 Hz in American English.

Also, in regard to the above-mentioned vowel components and consonant components, in Japanese these are classified simply as vowels and consonants, but in English the vowels are further classified into long vowels and short vowels, and with "S" and "Th," for example, the pronunciation is affected over a wide frequency band, so more complicated processing will be required, making this unsuitable for performing frequency division, for example.

In view of this, a function may be provided for switching the above-mentioned function on or off depending on the word, or for dynamically changing the frequency to be split according to the characteristics of the language.

(10)

The present invention may be constituted by combinations of the above embodiments and modification examples.

INDUSTRIAL APPLICABILITY

With the hearing aid device of the present invention, recognition is improved for consonants, which are important to understanding conversation, and this allows the user to clearly hear a conversation, so this hearing aid device is expected to find wide application.

REFERENCE SIGNS LIST

1 hearing aid device
2 right ear hearing aid
3 left ear hearing aid
4, 5 lead wire
6 signal processor
7 display component
8 switch
9 right ear microphone
10 frequency band analyzer
11 gain controller
11*a*, 11*b*, 11*c*, 11*d* gain controller
12 frequency band synthesizer
13 right ear speaker
14 left ear microphone
15 frequency band analyzer
16 gain controller
16*a*, 16*b*, 16*c*, 16*d* gain controller
17 frequency band synthesizer
18 left ear speaker
19 switching means
20 table
22, 23 sound input/output device

The invention claimed is:

1. A hearing aid device, comprising:

first and second hearing aids worn on the left and right ears; and a controller connected by wire or wirelessly to the first and second hearing aids, wherein the first hearing aid includes:

a first microphone;

a first frequency band analyzer that splits sound collected by the first microphone into a plurality of frequency bands;

a first gain controller that performs gain control on the frequency bands split by the first frequency band analyzer;

a first frequency band synthesizer that is connected to the first gain controller; and a first speaker that is connected to the first frequency band synthesizer, the second hearing aid includes:

a second microphone;

a second frequency band analyzer that splits sound collected by the second microphone into a plurality of frequency bands;

a second gain controller that performs gain control on the frequency bands split by the second frequency band analyzer;

a second frequency band synthesizer that is connected to the second gain controller; and a second speaker that is connected to the second frequency band synthesizer, the second gain controller sets the gain with respect to a high tone frequency band split by the second frequency band analyzer to be higher than the gain with respect to a low tone frequency band, and makes the second hearing aid into a high tone frequency band-use hearing aid, and the controller compares the sound pressure of the high tone frequency band split by the second frequency band analyzer of the second hearing aid with the sound pressure of the high tone frequency band split by the first frequency band analyzer of the first hearing aid, and if the sound pressure of the high tone frequency band of the first hearing aid is higher by at least a specific amount than the sound pressure of the high tone frequency band of the second hearing aid, the sound pressure of the high tone frequency band of the second hearing aid is raised.

2. The hearing aid device according to claim 1, wherein the controller compares the sound pressure of the high tone frequency band split by the second frequency band analyzer of the second hearing aid with the sound pressure of the high tone frequency band split by the first frequency band analyzer of the first hearing aid, and if the sound pressure of the high tone frequency band of the first hearing aid is higher by at least a specific amount than the sound pressure of the high tone frequency band of the second hearing aid, the sound pressure of the high tone frequency band of the first hearing aid is inputted to a high tone frequency band-use gain controller of the second gain controller.

3. The hearing aid device according to claim 1, wherein the controller compares the sound pressure of the high tone frequency band split by the second frequency band analyzer of the second hearing aid with the sound pressure of the high tone frequency band split by the first frequency band analyzer of the first hearing aid, and if the sound pressure of the high tone frequency band of the first hearing aid is higher by at least a specific amount than the sound pressure of the high tone frequency band of the second hearing aid, the amplification of the high tone frequency band-use gain controller of the second gain controller is raised.

4. The hearing aid device according to claim 1, the controller compares the sound pressure of the high tone frequency band split by the second frequency band analyzer of the second hearing aid with the sound pressure of the high tone frequency band split by the first frequency band analyzer of the first hearing aid, and if the sound pressure of the high tone frequency band of the first hearing aid is higher by at least a specific amount than the sound pressure of the high tone frequency band of the second hearing aid, the sound pressure of the high tone frequency band of the second hearing aid is raised to the sound pressure of the high tone frequency band of the first hearing aid.

5. A hearing aid device, comprising:

first and second hearing aids worn on the left and right ears; and a controller connected by wire or wirelessly to the first and second hearing aids, wherein the first hearing aid includes:

a first microphone;

a first frequency band analyzer that splits sound collected by the first microphone into a plurality of frequency bands;

a first gain controller that performs gain control on the frequency bands split by the first frequency band analyzer;

a first frequency band synthesizer that is connected to the first gain controller; and a first speaker that is connected to the first frequency band synthesizer, the second hearing aid includes:

a second microphone;

a second frequency band analyzer that splits sound collected by the second microphone into a plurality of frequency bands;

a second gain controller that performs gain control on the frequency bands split by the second frequency band analyzer;

a second frequency band synthesizer that is connected to the second gain controller; and a second speaker that is connected to the second frequency band synthesizer, the second gain controller sets the gain with respect to a high tone frequency band split by the second frequency band analyzer to be higher than the gain with respect to a low tone frequency band, and makes the second hearing aid into a high tone frequency band-use hearing aid, and the controller compares the sound pressure of a specific frequency band B split by the second frequency band analyzer of the second hearing aid with the sound pressure of a frequency band A which is split by the first frequency band analyzer of the first hearing aid and has a frequency band the same as the frequency band B, and if the sound pressure of the frequency band A of the first hearing aid is higher by at least a specific amount than the sound pressure of the frequency band B of the second hearing aid, the sound pressure of the frequency band B of the second hearing aid is raised.

6. The hearing aid device according to claim 5, the controller compares the sound pressure of a specific frequency band split by the second frequency band analyzer of the second hearing aid with the sound pressure of a specific frequency band split by the first frequency band analyzer of the first hearing aid, and if the sound pressure of the specific frequency band of the first hearing aid is higher by at least a specific amount than the sound pressure of the specific frequency band of the second hearing aid, the sound pressure of the specific frequency band of the second hearing aid is raised to the sound pressure of the specific frequency band of the first hearing aid.

* * * * *